US006817800B2

(12) United States Patent
Sung

(10) Patent No.: US 6,817,800 B2
(45) Date of Patent: Nov. 16, 2004

(54) WRITING TOOL

(75) Inventor: Yae Kyung Sung, Incheon (KR)

(73) Assignee: Morris Pen Corporation, Incheon (KR)

( * ) Notice: Subject to any disclaimer, the term of this patent is extended or adjusted under 35 U.S.C. 154(b) by 0 days.

(21) Appl. No.: 10/481,547

(22) PCT Filed: Feb. 8, 2002

(86) PCT No.: PCT/KR02/00210

§ 371 (c)(1),
(2), (4) Date: Dec. 19, 2003

(87) PCT Pub. No.: WO02/102604

PCT Pub. Date: Dec. 27, 2002

(65) Prior Publication Data

US 2004/0136772 A1 Jul. 15, 2004

(30) Foreign Application Priority Data

Jun. 19, 2001 (KR) ..... 10-2001-0034780

(51) Int. Cl.[7] ..... B43K 21/22; B43K 21/00

(52) U.S. Cl. ..... 401/93; 401/92; 401/55; 401/82

(58) Field of Search ..... 401/55, 56, 65, 401/67, 73, 82, 92, 93, 94

(56) References Cited

U.S. PATENT DOCUMENTS 4,358,210 A * 11/1982 Hashimoto et al. ..... 401/65
5,702,193 A * 12/1997 Kageyama et al. ..... 401/65
5,882,132 A * 3/1999 Kageyama et al. ..... 401/56
6,203,226 B1 * 3/2001 Suzuki et al. ..... 401/65

* cited by examiner

*Primary Examiner*—David J. Walczak
(74) *Attorney, Agent, or Firm*—Patterson, Thuente, Skaar & Christensen, P.A.

(57) ABSTRACT

A writing tool provided with enhanced and having a plurality of buttons arranged on lateral sides of the writing tool, whereby choice of raw materials for the tool are not limited and the writing tool has an improved endurance and productivity as they can be made of materials with excellent properties required in injection molding. The writing tool comprises an outer container 1 including a head member 9 in which a hole through which lead is exposed to the outside, is formed; a grip 13 in which a plurality of openings 11 are formed; a plurality of buttons 15, one portion of each positioned at each of the plurality of openings 11, while the remaining portion is positioned inside outer container; and an inner container 3 housin within outer container 1 and provided with a plurality of inclined faces 17 which are adapted to contact buttons 15 when pressed; wherein the inner container 3 moves forward within outer container 1, exposing the stored lead through head member 9 when at least one of buttons 15 is pressed down. The inclined faces 17 are arranged with a predetermined angle therebetween in a circumferential direction of the inner container 3 and are positioned at different places on an axis of inner container 3.

7 Claims, 4 Drawing Sheets

WRITING TOOL

TECHNICAL FIELD

The present invention relates to writing implements, and more particularly to a writing tool which externally extends a lead contained within an inner container by a simple knocking operation with a writer's fingers.

BACKGROUND ART

In general, various attempts have been tried to improve efficiency in using a writing tool in which press buttons are provided on a lateral side of the tool and a lead contained within the tool is exposed to the outside by pressing the button with a finger while the tool is held by the remaining fingers.

Such writing tools are provided with means for releasing the lead to expose it to the outside. For instance, when the press button is pressed, a pressing member mounted at an end of the press button depresses an inclined face of the inner container enclosing the lead, and a force exerted on the inclined face moves the inner container relatively forward.

Recently, there have been moves to improve efficiency in dealing with writing tools, in which more than two press buttons are provided on lateral surfaces of a writing tool and the lead contained within the tool is exposed to the outside by pressing either of the buttons with a finger while the tool is held by other fingers.

FIG. 7 illustrates an inside layout of one of the above-described conventional writing tools. As illustrated, two press buttons 53 that can be pressed down when the tool is grasped by fingers, are adapted on lateral sides of an outer container 51 in a symmetrical manner to each other about an axis of the outer container 53. Inside the outer container 51, there is provided an inner container 57 that can be moved forward by press buttons 53, allowing the lead to be exposed to the outside. The inner container 57 includes a conical portion defining an inclined face 59 on which a pressing member 53*a* of press button 53 comes in contact with the inclined face 59. When the press button 53 is "knocked," the pressing member 53*a* comes into contact with the inclined face 59 to depressing it, while moving down along inclined face 59, resulting such that inner container 57 moves forward to allow lead 55 to be exposed to the outside.

However, in the configuration of the prior art described above, since a portion of inner container 57 defining the inclined face 59 is a conical shape, symmetrical with respect to an axis of the inner container 57, as illustrated, the inner container 57 is provided with a narrow portion 61 having an excessively narrow outer diameter at a distal end of the inclined face 59.

Further, if a structural change is required to lengthen a travel distance of the inclined face 59 at one knocking operation without modifying an inclined angle of the inclined face 59 with respect to the axis of the inner container 57, the outer diameter of the narrow portion 61 must be seriously decreased.

The inner container 57 having such narrow portion 61 may be easily broken from a moderate external impact or cumulative internal fatigue caused by repeated depressing forces exerted on pressing member 53*a* on inclined face 59. For these reasons, the choice of suitable materials for conventional inner container 57 in known writing tools are restricted as such materials must have the necessary rigidity to prevent these problems.

As illustrated in the drawing, the narrow portion 61 of the inner container has an outer diameter unduly narrow relative to other portions. In conventional manufacturing processes, it is difficult to produce a resin article such as the inner container having its cross sectional area excessively changed by means of an injection molding. The finished product normally has a deteriorated quality since molten resin for that article cannot actively flow within a mold.

In accordance with the configurations of the prior art, the buttons 53 are arranged on lateral sides of the outer container 51 along one circumferential line. Thus, if the number of buttons 53 increases, the outer container 51 can be mechanically weakened as a plurality of openings 63 through which buttons 53 are positioned must be formed through outer container 51. Further, when a user presses buttons 53 as arranged in the above-described manner, there is an inconvenience as the user has to change finger positions while holding the writing tool to press buttons 53 as the positions of the thumb, index and middle fingers or the like, holding the writing tool are normally positioned on the outer container, being misaligned with the circumferential direction.

DISCLOSURE OF THE INVENTION

It is, therefore, an object of the present invention to provide a writing tool capable of resolving the aforementioned inconveniences in the art, which includes a structurally enhanced member moving in response to movements of a plurality of buttons arranged on lateral sides of the writing tool, whereby choice of raw materials for the tool are not limited and the writing tool has an improved endurance and productivity as the member has excellent properties required in injection molding.

It is another object of the present invention to make it easy for a user to operate the writing tool with her fingers, while holding the writing tool.

To accomplish these objectives, the present invention provides a writing tool comprising, an outer container including a head member in which a hole is formed through which a lead is exposed to the outside; a grip in which a plurality of openings are formed; a plurality of buttons, one portion of each being positioned at each of the plurality of openings, while the other portion being positioned inside the outer container; and an inner container housed within the outer container and provided with a plurality of inclined faces adapted to contact the buttons when the buttons are pressed; wherein the inner container moves forward within the outer container and exposes the stored lead out of the head member when at least one of the buttons is pressed, and the inclined faces are arranged within a predetermined angle therebetween in a circumferential direction of the inner container and are positioned at different places in an axis of the inner container.

Preferably, the predetermined angle between the inclined faces ranges from 110° to 165°; and an inclination angle of the inclined face with respect to the axis of the inner container ranges from 20° to 35°.

The plurality of buttons are angularly spaced apart with a predetermined angle therebetween in a circumferential direction of the outer container, while being positioned at different places in the axis of the outer container, in order to enable the buttons to be depressed by different fingers of a user, when the user holds the outer container.

The writing tool can also comprise an elastic member covering a surface of the grip of the outer container and extending over the openings.

BRIEF DESCRIPTION OF THE DRAWINGS

The above and other objects and features of the present invention will become apparent from the following detailed description in conjunction with the accompanying drawings.

MODE OF CARRYING OUT THE INVENTION

An embodiment of the present invention will now be described in detail with reference to the accompanying drawings.

Figure 1:
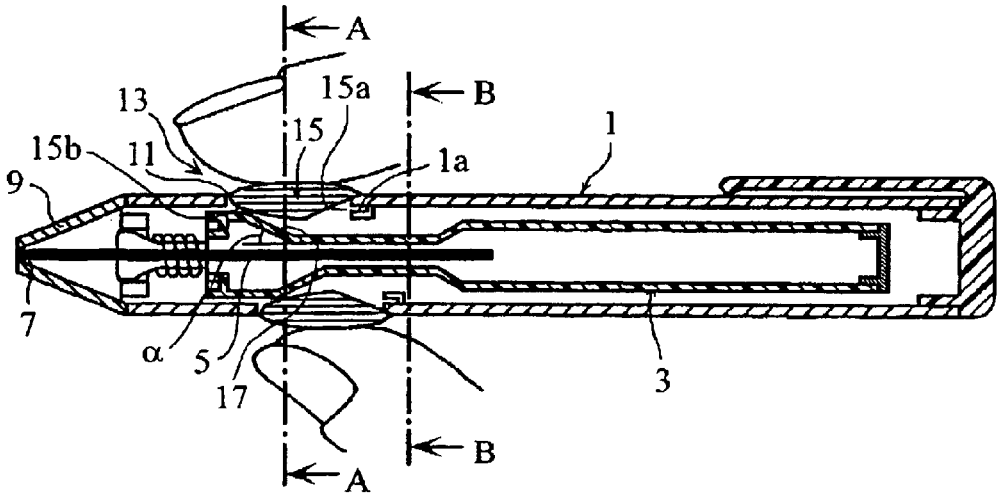
FIG. 1 is a sectional view depicting the inside layout of a writing tool in accordance with the present invention.

FIG. 1 depicts an inside layout of a writing tool in accordance with the present invention. Referring to FIG. 1, there is illustrated a writing tool having a long outer container 1 and an inner container 3, received in the outer container 1, for exposing a lead 5 contained therein to the outside of the outer container 1.

The outer container 1 includes a head member 9 in which is formed an opening for a hole 7, through which the lead 5 is exposed and a grip 13 having a plurality of openings 11 are formed. Buttons 15 are positioned through the plurality of openings 11 formed at the grip 13, respectively.

One portion of the button 15 is projected out of the outer container 1 through the opening 11, and the other portion remains inside the outer container 1. As illustrated, the button 15 is mounted in the outer container 1 in such a manner that an end 15*a* of the button 15 is engaged in a groove 1*a* formed near the opening 11. As a modification, the end 15*a* of the button 15 can be integrally formed with the outer container 1 as one body. As another modification, the button 15 may exist as an independent component from the outer container 1 instead of its end 15*a* being fixed to the outer container 1.

The inner container 3 is provided with a plurality of inclined faces 17 which come into contact with a forward end 15*b* of the button 15 and, therefore, when one of the buttons 15 is pressed down or knocked down, the inner container 3 moves forward within the outer container 1, allowing the lead 5 to be exposed out of the head member 9 of the outer container 1.

The inclined face 17 may have a predetermined angle $\alpha$ ranging in approximately 20° to 35° relative to an axis of the inner container 3. The range of the angle $\alpha$ can be determined under consideration of an advancement distance of the inner container 3 when the button 15 is knocked down once, i.e., the length of the lead 5 exposing out of the head member 9, and the diameter of the outer container 1.

If an inclination angle of the inclined face 17 becomes less or greater than the range of the angle $\alpha$, the travel distance of the inner container 3 and the length of the lead 5 become less or greater. In this case, if the exposed amount of the lead 5 at a time is too long, it is easy to for the lead 5 to be broken during writing. On the other hand, if the exposed amount of the lead 5 at a time is too short, it is cumbersome to press the button 15 many times to obtain a proper length of the lead 5.

If the inclination angle of the inclined face 17 becomes out of the preferred range of the angle $\alpha$ under a condition where the preferred advancement distance of the inner container 3 is kept constant, a length of a vertical component of the inclined face 17, i.e. a length of the inner container 3 in a transversal direction of the axis of the inner container 3 becomes too small or too large, which, in turn, results a too small diameter or a too large diameter of the inner container 3. Therefore, the diameter of the outer container 1 enclosing the inner container 3 becomes too small or too large. It is inappropriate for the user to hold such outer container 1 to write with the writing tool.

Figure 2A:
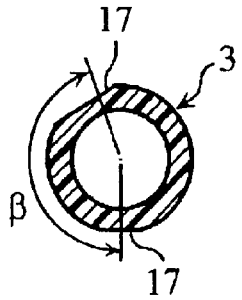
FIG. 2A is a cross-sectional view of an inner container taken along line A—A in FIG. 1.

Referring to FIG. 2A, the inclined faces 17 are arranged with each other with a predetermined angle $\beta$, preferably 110° to 165° in a circumferential direction thereof, and they are positioned at different places in the axis of the inner container 3. The above range of the angle $\beta$, conventionally reflects angles between portions of the outer container 1 on which the fingers of the user's are normally contacted when the user holds the writing tool. That is, if the angle between the inclined faces 17 is set out of the range of the angle $\beta$, the distance between the buttons 15 in the circumferential direction of the outer container 3 becomes narrower or wider, as will be discussed below. Thus, it is also inconvenient for the user to knock the button 3 with his fingers holding the writing tool.

Figure 2B:
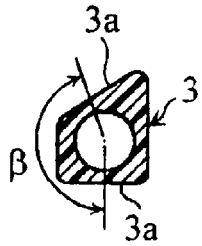
FIG. 2B is a cross-sectional view of the inner container taken along line B—B in FIG. 1.

FIG. 2B is a cross-sectional view of the inner container 3 taken along line B—B in FIG. 1. The cross-sectional shape is a quadrangle of which side faces 3*a* are formed to extend from the inclined faces 17 along the axis of the inner container 3 at upper and lower portions thereof. The side faces 3*a* are arranged with the angle $\beta$, therebetween. This sectional shape provides a strengthened configuration in a structural aspect compared to a rectangular shape having upper and lower side faces parallel with each other, e.g. a parallelogram, thereby more efficiently preventing bending of the structure caused by an external force.

Figure 3:
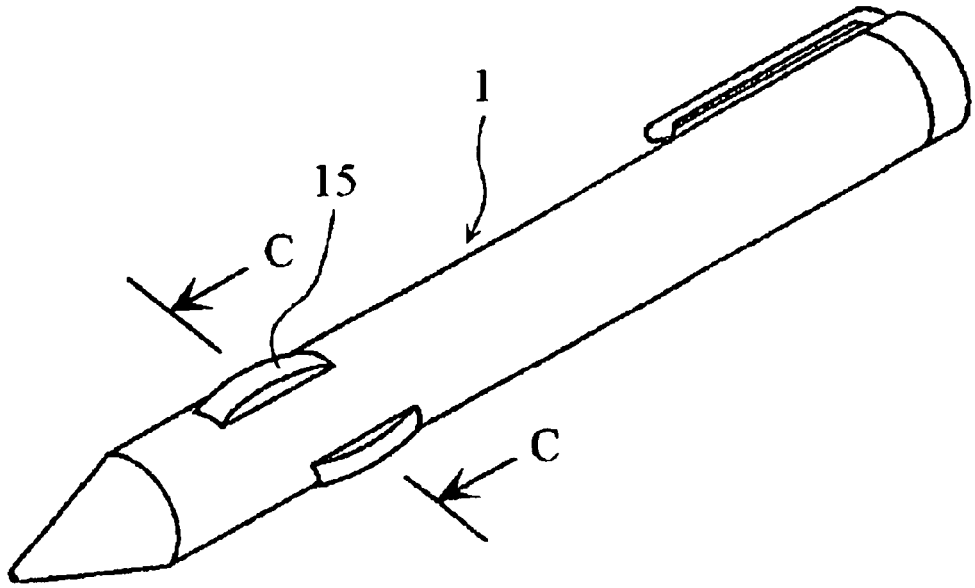
FIG. 3 is an elevated perspective view of the writing tool of FIG. 1.

FIG. 3 depicts the outer appearance of the writing tool of in FIG. 1. Positions of the buttons 15 at the outer container 1 correspond to those of the inclined faces 17 of the inner container 3. Similar to the inclined faces 17, the buttons 15 are angularly spaced from one another with the angle $\alpha$ therebetween in a circumferential direction of the outer container 1 and they are positioned at different places in the axis of the outer container 1.

Operations of the writing tool in accordance with the present invention will now be discussed with reference to FIGS. 1 to 5.

Referring to FIG. 1, under a circumstance that a user of the writing tool with a lead 5 filled inside the inner container 3 holds the tool and presses at least one of buttons 15 with at least one of the user's finger being contacted to the buttons 15, a forward end 15*b* of the buttons 15 is rotated down through an opening 11 and comes into contact with an inclined face 17 of the inner container 3. In this state, when the buttons 15 are further pressed, the forward end 15*b* contacts and presses the inclined face 17 in a rotating manner. As a result, the inner container 3 moves forward.

Figure 5:
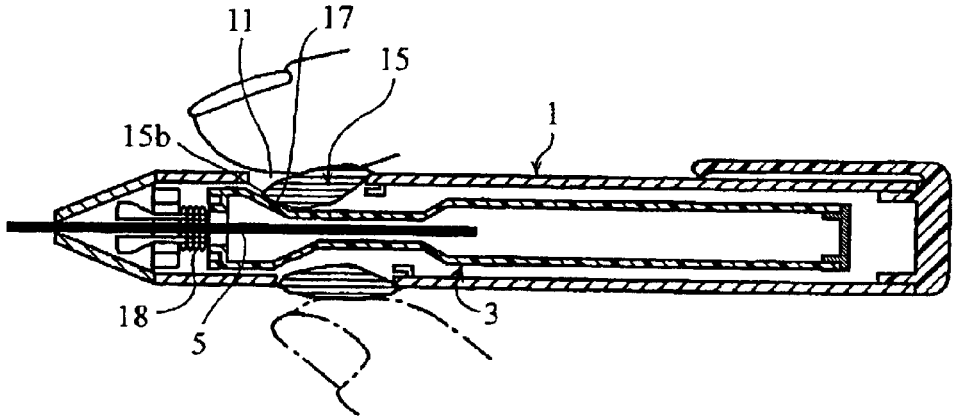
FIG. 5 is a sectional view showing an inside layout when a button of the writing tool, as depicted in FIG. 1, is depressed.

FIG. 5 shows a completion of the pressing action onto the button 15 where the forward end 15*b* is positioned at a lower end of the inclined face 17 and a head of the lead 5 is positioned out of a head member of the outer container 1. If the user removes his finger's pressing force from the button 15, the inner container 3 moves backward in response to a restoration of a spring 18 which has been compressed, while the lead 5 stays exposed to the outside, and the button 15 is rotated up and becomes a standby mode for subsequent pressing operations as illustrated in FIG. 1.

In accordance with the writing tool of the present invention, the inner container 3 is provided with the inclined faces 17 which are arranged at different angles from each other, and thus it has no narrow portion as can be seen from conventional inner containers. In other words, variations of a cross-sectional area of portions between the inclined faces 17 at both ends of the inner container are gentle along the axis of the inner container 3. Accordingly, in performing an injection molding for the inner container 3 having the above inclination structure, the molten resin within a mold can properly flow, thereby enabling a manufacturing process for a good quality of product having desired specifications.

In addition, as it is possible for the inventive inner container 3 to have the desired specification by means of the injection molding, extra reinforcement process for making up the structural weakness of the inner container is not necessary. Accordingly, it may reduce a limitation in choosing raw materials for the inner container in view of the structural weakness.

Figure 4:
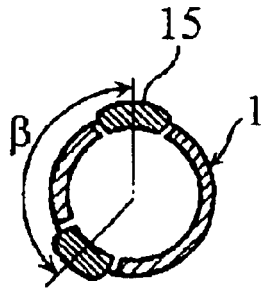
FIG. 4 is a cross-sectional view of an outer container taken along line C—C in FIG. 3.

Furthermore, according to the writing tool of the present invention, a user can extend easily the lead 5 from the outer container 1 only by pressing one of the buttons 15 with any finger being in contact with the buttons, while holding the tool. That is, as shown in FIGS. 3 and 4, since the buttons 15 are differently positioned from each other in the circumferential direction and the axis of the outer container 1, when the user holds the tool with his fingers, it is possible for at least two fingers, for instance, the thumb and the index fingers, the index and middle fingers, or the thumb and the middle fingers to be naturally contacted to the buttons. This makes possible for the user to operate the buttons easily without changing the position of his fingers holding the writing tool.

Figure 6:
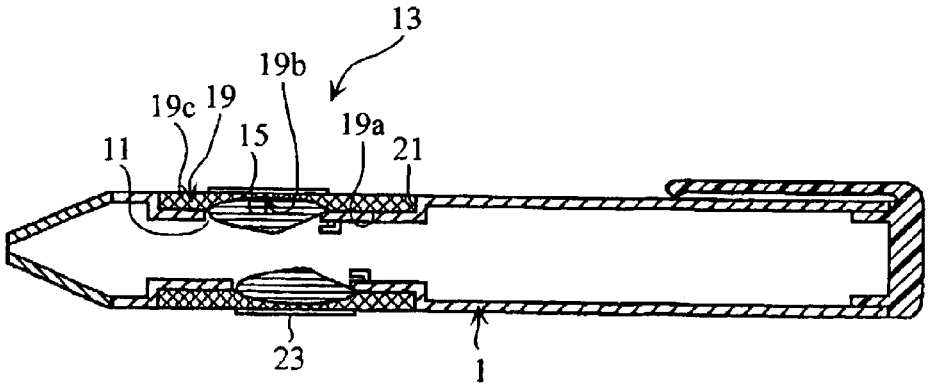
FIG. 6 is a sectional view showing an elastic member mounted to cover a grip of the writing tool as depicted in FIG. 1.
Figure 7:
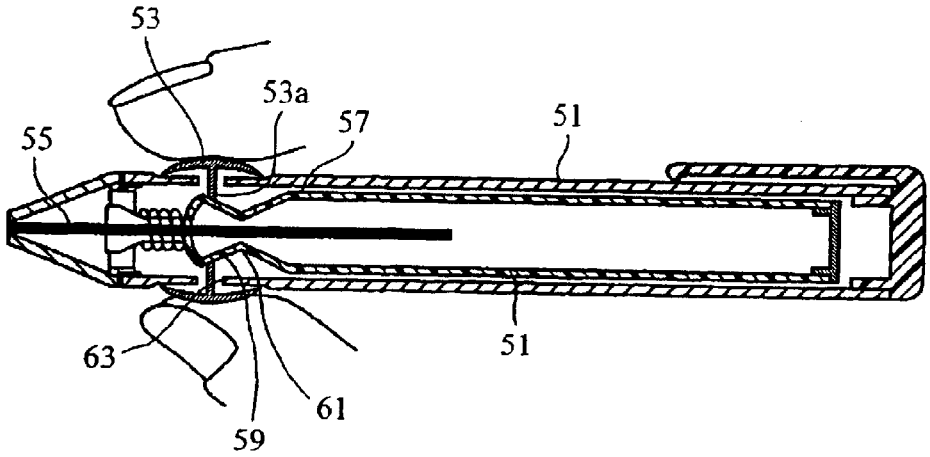
FIG. 7 shows an inside layout of a conventional writing tool.

FIG. 6 is a sectional view showing that an elastic member is mounted to cover a grip of the writing tool as depicted in FIG. 1. The elastic member 19 has an open-ended tubular shape and it covers an external surface of the grip of the outer container 1 and extends over the openings 11 formed in the grip 13. It is preferable that a material for the elastic member 19 be a resin having elasticity such as silicon or rubber.

Preferably, the elastic member 19 may be positioned within a groove 21 formed along circumferential direction of the grip 13 of the outer container 1. In an inner face 19*a* of the elastic member 19, there formed a plurality of recesses 19*b* for receiving portions of the buttons 15 projected out of the outer container 1. Since the recess 19*b* receives the projected portion of the button 15, the button 15 is not unintentionally pressed by the elasticity of the elastic member 19 positioning on the button 15. A button-press indicia 23 is formed on an outer surface 19*c* of the elastic member 19 so that the user can recognize position of the button 15 concealed beneath the elastic member 19. The button-press indicia 23 may be formed in a form of a protuberance and a silk-screen print may be performed at a place corresponding to the position of the recess 19*b* to form the indicia 23.

With the configuration described above, the elastic member 19 encloses a gap between the button 15 and the opening 11 so that no alien material, which may cause a malfunction of the writing tool, can penetrate into the gap. The user also feels comfortable from the elasticity of the elastic member when holding the writing tool through the elastic member 19.

While the present invention has been described with reference to its preferred embodiments, it will be apparent to those skilled in the art that variations and modifications are possible without deviating from the broad principles and teachings of the present invention which are defined by the following claims.

What is claimed is:

1. A writing tool, comprising:

an outer container, further comprising a head member in which an aperture is formed creating a hole through which lead is exposed to the outside, and a grip in which a plurality of openings are formed;

a plurality of buttons, one portion of each positioned at each of the plurality of openings, while the other portion is positioned inside the outer container; and an inner container housed within the outer container and provided with a plurality of inclined faces adapted to contact said buttons when the buttons are depressed, the inner container moving forward within the outer container and exposing the lead stored therein out of said head member when at least one of the buttons is depressed;

wherein the inclined faces are arranged with a predetermined angle therebetween in a circumferential direction of said inner container and are positioned at different places along an axis of the inner container.

2. The writing tool of claim 1, wherein the predetermined angle ranges from 100° to 165°.

3. The writing tool of any one of claim 2, wherein said plurality of buttons are angularly spaced apart with a predetermined angle therebetween in a circumferential direction of said outer container and positioned at different places in the axis of said outer container, whereby adapting said buttons to contact different fingers of a user, when the user holds the outer container.

4. The writing tool of claim 1, wherein an inclination angle of the inclined face with respect to the axis of said inner container ranges from 20° to 35°.

5. The writing tool of any one of claim 4, wherein said plurality of buttons are angularly spaced apart with a predetermined angle therebetween in a circumferential direction of said outer container and positioned at different places in the axis of said outer container, whereby adapting said buttons to contact different fingers of a user, when the user holds the outer container.

6. The writing tool of claim 1, wherein said plurality of buttons are angularly spaced apart with a predetermined angle therebetween in a circumferential direction of said outer container and positioned at different places in the axis of said outer container, whereby adapting said buttons to contact different fingers of a user, when the user holds the outer container.

7. The writing tool of claim 1, further comprising an elastic member covering a surface of the grip of the outer container and extending over said openings.

* * * * *